US006065635A

United States Patent [19]

Sullivan

[11] Patent Number: 6,065,635

[45] Date of Patent: May 23, 2000

[54] FILTER STRAW WITH CAP

[76] Inventor: John L. Sullivan, 1362 NE. 117th St. North, Miami, Fla. 33161

[21] Appl. No.: 09/251,261

[22] Filed: Feb. 12, 1999

[51] Int. Cl.[7] ..... B65D 47/00

[52] U.S. Cl. ..... 220/709; 220/719; 215/229

[58] Field of Search ..... 220/709, 717, 220/719, 370, 371, 372; 215/229

[56] References Cited

U.S. PATENT DOCUMENTS

| | | | |
|---|---|---|---|
| 3,173,566 | 3/1965 | Talbert | 215/229 |
| 3,977,560 | 8/1976 | Stumpf et al. | 220/371 X |
| 4,494,668 | 1/1985 | Lottick | 215/229 X |
| 5,361,934 | 11/1994 | Spence, Jr. | 220/709 X |
| 5,381,924 | 1/1995 | Kiefel | 220/709 |
| 5,388,712 | 2/1995 | Brody | 215/229 |
| 5,497,920 | 3/1996 | Moeller et al. | 220/719 X |
| 5,520,304 | 5/1996 | Lin | 220/709 X |

*Primary Examiner*—Steven Pollard
*Attorney, Agent, or Firm*—J. Sanchelima

[57] ABSTRACT

A mouthpiece filter for a container that includes an outer thread on the neck of the container. The filter includes an elongated filter member removably and coaxially mounted within the container and press fit to a cap housing that in turn is mounted to the container. The filter member includes an inlet end and an outlet end. The outlet end includes a mouth piece termination that is press fit through a centrally disposed tubular member on top of a cylindrical housing with a internal thread. A shoulder at the outlet end is cooperatively received by a counterbore adjacent to the centrally disposed opening on the internal surface of the upper wall.

4 Claims, 1 Drawing Sheet

FILTER STRAW WITH CAP

BACKGROUND OF THE INVENTION

1. Field of the Invention.

The present invention relates to a mouthpiece filter that is adaptable to bottles and containers with an opening adjacent to a peripheral wall.

2. Description of the Related Art.

Many designs that include assemblies with straws and caps exist. However, none of them includes a filter incorporated removably mounted to a cap. Also, these designs attempt to make the devices water tight with vents to prevent the creation of a vacuum inside the vessel. The present invention utilizes a vessel with a threaded neck that cooperates to permit it to breath (relief) merely rotating the cap one quarter of a turn.

Applicant believes that the closest reference corresponds to U.S. Pat. No. 5,381,924 issued to Kiefel. However, it differs from the present invention because it lacks the filter and it does not provide for relief to prevent the creation of a vacuum inside the vessel.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a mouthpiece filter that has such a configuration that is removably press fit over a container's outer peripheral wall adjacent to the opening.

It is another object of this invention to provide a mouthpiece filter that can be used without the closure member.

It is still another object of the present invention to provide a volumetrically efficient and rugged mouthpiece filter that can be readily stored and transported.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
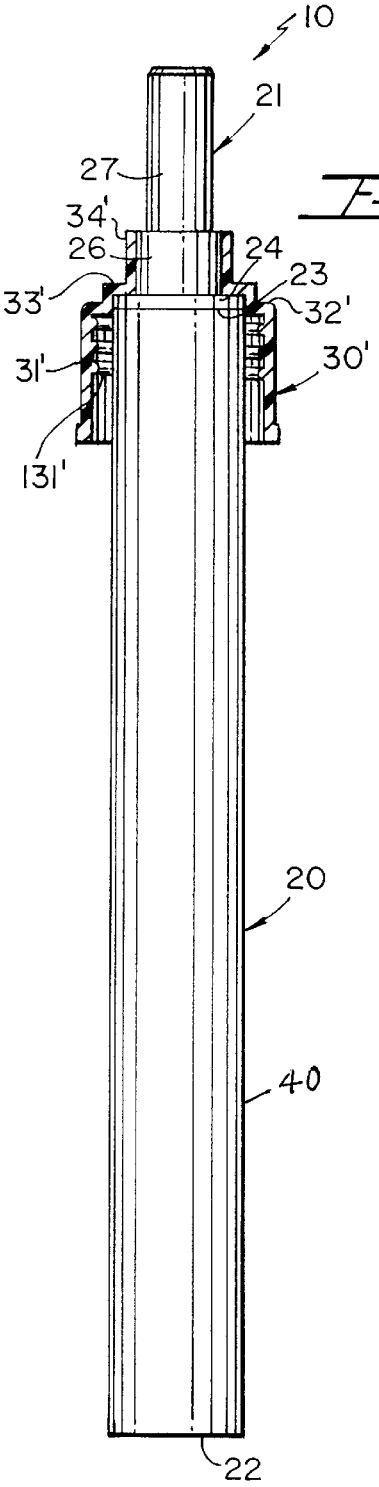
FIG. 2 is an elevational view of the elongated mouthpiece filter that includes a closure cap member of smaller diameter. The closure cap is shown in an elevational cross section.

Referring now to the drawings, where the present invention is generally referred to with numeral 10, it can be observed that it basically includes elongated filter assembly 20 removably press fit through closure cap member 30. Closure cap member 30 is removably mounted to the threaded neck of container C.

Figure 1:
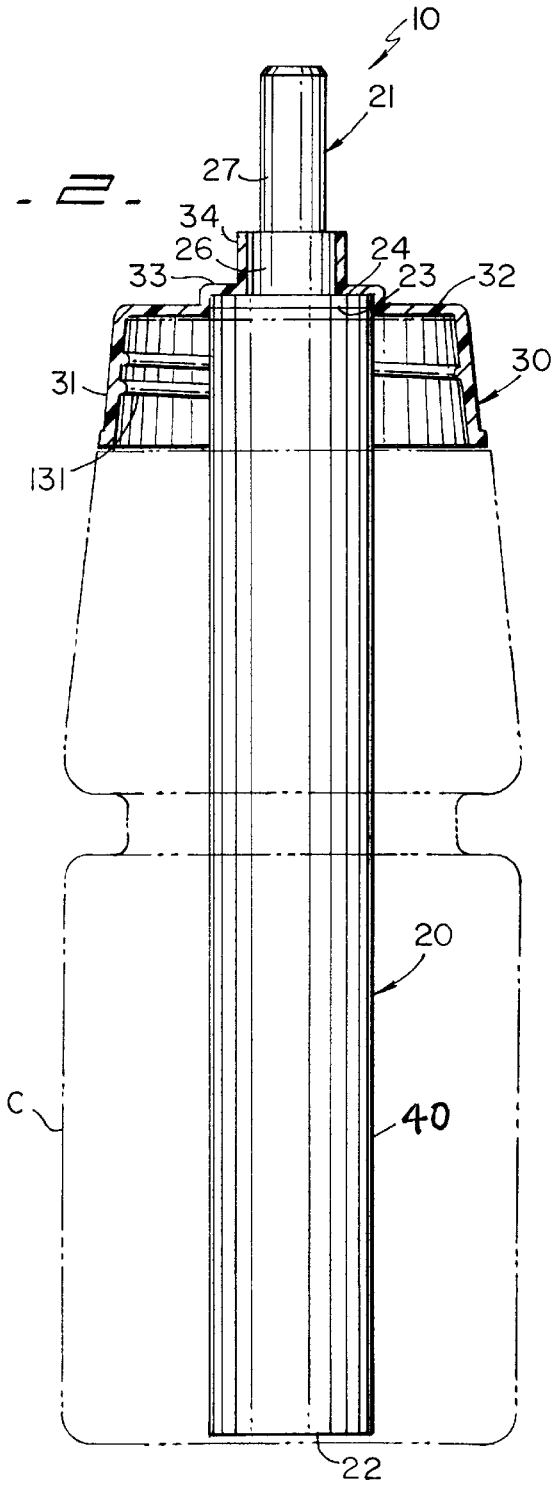
FIG. 1 an elevational view of an elongated filter that is snugly mounted within a container shown in phantom.

Elongated filter assembly 20 has a tubular elongated housing with filtering chambers disposed in series therein that permit the liquid to flow through. Elongated filter assembly 20 has inlet 22 and outlet 23 located at its opposite ends. Mouthpiece 21 is rigidly mounted to outlet 23 and facilitates sucking the liquid from container C through inlet 22, outlet 23 and mouthpiece assembly 21, as illustrated in FIG. 1. Inlet 22 extends, preferably, to the bottom of container C. Mouthpiece assembly 21, in the preferred embodiment, has a tubular configuration and includes shoulder 24 next to one end. Mouthpiece assembly 21 also includes lower and upper tubular members 26 and 27, respectively. Tubular member 27 has cooperative dimensions to be press fit within tubular member 34 of closure cap 30. Mouthpiece member 28 is outwardly projected defining the mouthpiece member of elongated filter member 20. Lower tubular member 26 is press fit inside filter tubular member 40 with the upper end of member 40 abutting against shoulder 24.

Closure cap member 30, in the preferred embodiment, includes skirt 31 that is downwardly and perpendicularly extended from upper wall 32. Skirt 31 includes thread 131 in its inner wall. Upper wall 32 has step 33 and perpendicularly extending tubular member 34. Tubular member 34 includes through opening to cooperatively and snugly receive tubular member 27 of filter 20, as mentioned above. Step 33 forms a counter bore internally with cooperative dimensions to abuttingly receive shoulder 24 of filter 20, as illustrated in FIGS. 1 and 2. In this manner, filter member 20 is firmly engaged to closure cap 30.

Similar to closure cap 30, closure 30' includes skirt 31' with threads 131', upper wall 32', step 33' and tubular member 34'. Closure 30' is used with containers with smaller threaded necks.

When drawing liquid from container C a user rotates cap member 30 one quarter of a turn to permit the air through preventing the creation of a vacuum inside container C.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mouthpiece filter for a container having a neck with an outer thread on its periphery, comprising:

A) a cylindrical cap housing having an internal thread for cooperative engagement to said outer thread and an upper wall member with a centrally disposed opening, said upper wall member includes a perpendicularly mounted tubular member over said opening and said internal thread having cooperative dimensions to permit to air come inside a container when said cylindrical cap housing is turned while still maintaining engagement to said neck; and B) an elongated filter member having first and second ends, said first end being the inlet for said filter and said second end being the outlet of said filter, and further including a tubular mouthpiece member mounted to said second end and having cooperative dimensions to be press fit within said tubular member so that a portion of said tubular mouthpiece member protrudes outwardly through said tubular member.

2. The mouthpiece filter set forth in claim 1 wherein said tubular mouthpiece is removably mounted within said tubular member.

3. The mouthpiece filter set forth in claim 2 wherein the engagement of said tubular mouth piece and said tubular member is water tight.

4. The mouthpiece filter set forth in claim 3 wherein the engagement of said tubular mouth piece member to said second end defines a shoulder and upper wall includes a step portion adjacent to said centrally disposed opening thereby defining a counterbore of cooperative dimensions to receive said shoulder.

* * * * *